United States Patent [19]

Miyazaki et al.

[11] Patent Number: 4,950,507

[45] Date of Patent: Aug. 21, 1990

[54] METHOD FOR APPLYING A COATING COMPOSITION HAVING A SPARKLING LUSTER CONTAINING $FEO_3$ PARTICLES OF HEXAGONAL PLATE-LIKE SHAPE

[75] Inventors: Shizuo Miyazaki, Okazaki; Kazuyuki Kuwano, Toyota; Norio Fujita, Nagoya, all of Japan

[73] Assignees: Toyota Jidosha Kabushiki, Toyota; Kansai Paint Co., Ltd., Amagasaki, both of Japan

[21] Appl. No.: 278,508

[22] Filed: Dec. 1, 1988

[30] Foreign Application Priority Data

Dec. 7, 1987 [JP] Japan ..... 62-310395
Mar. 4, 1988 [JP] Japan ..... 63-51823

[51] Int. Cl.[5] ..... B05D 1/36; B05D 7/00

[52] U.S. Cl. ..... 427/419.2; 427/407.1; 427/409; 427/419.5

[58] Field of Search ..... 427/419.2, 419.5, 409, 427/410, 407.1, 402

[56] References Cited

U.S. PATENT DOCUMENTS 4,382,114 5/1983 Hohlein et al. ..... 427/407.1
4,416,940 11/1983 Loye et al. ..... 427/407.1
4,477,536 10/1984 Wright et al. ..... 427/407.1
4,539,258 9/1985 Panush ..... 427/407.1
4,546,007 10/1985 Abe et al. ..... 427/407.1
4,551,387 11/1985 Manabe et al. ..... 427/407.1
4,552,780 11/1985 Abe et al. ..... 427/407.1
4,615,940 10/1986 Panush et al. ..... 427/407.1
4,728,543 3/1988 Kurauchi et al. ..... 427/419.5
4,755,434 7/1988 Fujii et al. ..... 427/407.1
4,781,949 11/1988 Kasari ..... 427/407.1
4,814,208 3/1989 Miyazaki et al. ..... 427/407.1

FOREIGN PATENT DOCUMENTS 58-128852 8/1983 Japan ..... 427/419.5

*Primary Examiner*—Sadie Childs

[57] ABSTRACT

Disclosed is a metallic coating method comprising the steps of applying a color coating composition, applying a metallic coating composition containing a metallic pigment to the layer of the color coating composition and applying a clear coating composition to the layer of the metallic coating composition, the method being characterized in that the color coating composition is able to form a layer having a Munsell value of 0 to 6; that the metallic coating composition contains a metallic pigment and a vehicle as main components, the metallic pigment being iron oxide particles of hexagonal platelike shape which contain at least 80% by weight of $\alpha$-iron oxide crystals; that about 90% by weight or more of the metallic pigment has a longitudinal size of about 30 $\mu$m or less and 40% by weight or more of the pigment has a longitudinal size of about 5 to about 15 $\mu$m; that the thickness of the pigment is about 1/10 to about 1/20 of the longitudinal size of the pigment; and that the amount of the pigment used is about 0.1 to about 30 parts by weight per 100 parts by weight of the vehicle (as solids).

7 Claims, No Drawings

METHOD FOR APPLYING A COATING COMPOSITION HAVING A SPARKLING LUSTER CONTAINING $FeO_3$ PARTICLES OF HEXAGONAL PLATE-LIKE-SHAPE

This invention relates to a novel metallic coating method.

High-grade metallic coating methods are known for producing a finish coat of sparkling luster on the automotive body panels and the like. The methods frequently used comprise, after or without applying a color coating material, applying a metallic coating material containing a metallic pigment such as flaky aluminum powder or the like and a clear coating material. However, the methods have the drawbacks of forming a metallic coat unsatisfactory in sparkling luster and providing a finish coat with substantially no sparkling luster, when intended for deep colored coat. Further the metallic coat given by the methods looks lusterless or dull in luster when viewed at an angle other than the angle of specular reflection or, in other words, produces a substantial flip-flop effect, hence undesirable in appearance. Moreover, the aluminum powder used is susceptible to the chemical change due to acids and alkalis so that the finish coat tends to create blisters and blotches which lower the serviceability of the coat. With these defects, aluminum powders and the like are inadequate to use in application of high-grade finish coats on the automotive body panels and so on, and pose the problems such as diminish of serviceability.

It is an object of the present invention to provide a novel metallic coating method capable of forming a finish coat, even when deep colored, having a noticeably sparkling luster.

It is another object of the invention to provide a novel metallic coating method capable of forming a finish coat which produces little or no flip-flop effect and which looks sparkling when viewed from any direction.

It is a further object of the invention to provide a novel metallic coating method capable of forming a finish coat of sparkling luster which possesses the desired serviceability of coat owing to its high resistance to acids and alkalis.

These and other objects of the present invention will become more apparent from the following description.

The present invention provides a metallic coating method comprising the steps of applying a color coating composition, applying a metallic coating composition containing a metallic pigment to the layer of the color coating composition and applying a clear coating composition to the layer of the metallic coating composition, the method being characterized in that the color coating composition is able to form a layer having a Munsell value of 0 to 6; that the metallic coating composition contains the metallic pigment and a vehicle as main components, the metallic pigment being iron oxide particles of hexagonal platelike shape which contain at least 80% by weight of $\alpha$-iron oxide crystals; that about 90% by weight or more of the metallic pigment has a longitudinal size of about 30 $\mu$m or less and 40% by weight or more of the pigment has a longitudinal size of about 5 to about 15 $\mu$m; that the thickness of the pigment is about 1/10 to about 1/20 of the longitudinal size of the pigment; and that the amount of the pigment used is about 0.1 to about 30 parts by weight per 100 parts by weight of the vehicle (as solids).

We conducted extensive research to overcome the foregoing drawbacks of the prior art metallic coating methods and found the following.

(1) When a metallic coating composition incorporating as a metallic pigment the iron oxide particles containing $\alpha$-iron oxide crystals particularly of hexagonal platelike shape which have never been heretofore employed as a metallic pigment in place of the aluminum powder is applied to the surface of the layer of color coating composition having a color adjusted to a low lightness before application of a clear coating composition, even a deep-color finish coat is given a pronounced degree of sparkling luster.

(2) The metallic coat thus formed has substantially no flip-flop effect and looks brilliantly sparkling as viewed from any direction.

(3) The iron oxide particles are so outstanding in resistance to acids and alkalis that the particles serve to provide a coat with good serviceability.

The present invention has been accomplished based on these novel findings.

It is critical in the invention to use a metallic coating composition incorporating as a metallic pigment iron oxide particles of hexagonal platelike shape containing at least 80% by weight of $\alpha$-iron oxide crystals. The iron oxide particles to be contained therein are hexagonal platelike crystals and have an opaque, remarkable metallic luster. As a result, light beams are reflected in a sparkling glitter on reaching the iron oxide surface in the metallic layer. The degree of glitter thus produced is pronouncedly higher than when given by aluminum powder or the like, and particularly this tendency is marked in sunlight. Furthermore, the metallic coat formed is practically constant in sparkling luster when viewed from different angles.

When exposed to the direct rays of the sun or the like, the layer of iron oxide particles-containing metallic coating composition (hereinafter the metallic coating composition will be referred to as "metallic coating") as seen from any angle shows a uniquely sparkling metallic luster appearing as if the luster originated in the depth of layer, and looks three-dimensional. In addition, the iron oxide particles are high in chemical resistances such as acid resistance and alkali resistance, light resistance, weatherability, heat resistance, adherence and the like.

To fully produce the attractive sparkling luster by the iron oxide particles, the iron oxide particles-containing metallic coating needs to be applied to the surface of layer of color coating composition (hereinafter referred to as "color coating") having a Munsell value adjusted to 0 to 6. More specifically, when deposited on the layer of color coating adjusted to a low value, the iron oxide particles-containing metallic coating can provide the full extent of glitter unique to the particle. As a result, the multi-layer metallic coat looks sparkling, for example, as if inlaid with diamonds in the depth. The remarkable characteristics of finish coat as produced above can not be obtained by using aluminum powder or the like.

According to the coating method of the present invention, a desired color design can be easily achieved on the basis of the color of color coating layer.

The metallic coating method of the present invention will be described below in greater detail.

First, the color coating will be discussed.

The color coating to be used in the invention comprises a vehicle component and a color pigment as main components and is capable of forming a layer having a Munsell value of 0 to 6, preferably 0.3 to 4. The color coating is applied prior to application of metallic coating. The term "Munsell value" used herein refers to the value which is one of the three attributes of color, i.e. value, hue and chroma. The Munsell value exceeding 6 is inadequate because it makes the finish coat too bright, exceedingly diminishing the degree of sparkling luster originated in the iron oxide particles. The value of color coating layer is easily controllable by determining, e.g., the kind, composition and amount of color pigment contained in the color coating.

The color coating to be used in the present invention is one capable of forming a layer having the value in the above range. Useful color coatings are those which can produce a layer of said lightness and which are in the form of an organic solvent solution, nonaqueous dispersion, water-dispersible solution, aqueous solution, solvent-free form, powder or the like among which an organic solvent solution is preferred to retain the finish appearance, serviceability and the like at high levels.

The vehicle component of the color coating contains a base resin as a main component and when required, a curing agent or crosslinking agent such as amino resins, isocyanate compounds, blocked isocyanate compounds, polyamide resins or the like. The base resin used is known one selected from acrylic resins, alkyd resins, polyester resins, epoxy resins and modified resins thereof, etc.

The color coating of the invention can be cured at room temperature or by heating, or in other words can be hardened by crosslinking (curing) or without crosslinking (drying).

It is suitable that the color coating be applied to a thickness of about 10 to about 50 μm, preferably about 20 to about 35 μm when cured or dried. Preferably the application thereof is done to cause the layer to completely conceal the surface of substrate.

Next, the iron oxide particles-containing metallic coating will be discussed below.

The metallic coating to be used in the invention is applied to the surface of the layer of color coating and predominantly contains a metallic pigment and a vehicle component. The metallic pigment contained therein is a particulate iron oxide of hexagonal platelike shape containing as a main component α-iron oxide crystals, about 90% by weight or more of the pigment being about 30 μm or less in longitudinal size, about 40% by weight or more thereof being about 5 to about 15 μm in longitudinal size, and the thickness thereof being about 1/10 to about 1/20 of the longitudinal size thereof. The amount of the iron oxide particles for use is about 0.1 to about 30 parts by weight per 100 parts by weight (as solids) of the vehicle component.

More specifically, the iron oxide particles to be used as a metallic pigment of the present invention are of hexagonal platelike shape and have an outstanding surface smoothness and contain α-iron oxide ($Fe_2O_3$) crystals as a main component. The platelike iron oxide particles contain at least 80% by weight, preferably about 95% by weight or more, more preferably about 99% by weight or more, of α-$Fe_2O_3$ crystals but 20% by weight or less of impurity such as $SiO_2$, FeO, Mn and the like. The metallic pigment per se has a sparkling luster.

Useful iron oxide particles are of hexagonal platelike shape having a specific distribution of particle size with respect to the range of longitudinal size. Stated more specifically, it is essential in the invention that about 90% by weight or more, preferably about 95% by weight or more, of the pigment be distributed among about 30 μm or less in longitudinal size and about 40% by weight or more, preferably 50% by weight or more, of those be distributed among about 5 to about 15 μm in longitudinal size, as determined by a laser-type particle size distribution measuring device (PARTICLE SIZER 2200, product of Malvern Co., U.K.). Of the pigments of about 5 to about 15 μm longitudinal size, those of about 10 to about 15 μm longitudinal size are suitably used in an amount of about 25% by weight or more, more preferably about 32% by weight or more. The term "longitudinal size" used herein is intended to mean the size as measured in a direction of the diagonal line of virtually equilateral hexagonal particle surface.

It is also critical in the invention that the thickness of the particles be about 1/10 to about 1/20, preferably about 1/10 to about 1/15, of the longitudinal size thereof.

If less than 40% by weight of the particles used has a longitudinal size of about 5 to about 15 μm and a larger amount thereof has a longitudinal size of less than about 5 μm, or if the particles used has a thickness of less than 1/20 of the longitudinal size, the sparkling luster of the finished metallic coat reduces and thus the particles of above-defined thickness used in such range of amount is undesirable. If less than 40% by weight of the particles used has a longitudinal size of about 5 to about 15 μm and a larger amount thereof has a longitudinal size of greater than 15 μm, or if less than 90% by weight thereof has a longitudinal size of less than 30 μm, or if the particles used has a thickness of greater than 1/10 of the longitudinal size, the coat surface has an increased number of iron oxide particles protruded therefrom, which leads to the impairment of finish characteristics, hence undesirable.

The vehicle component of the metallic coating is used to disperse the iron oxide particles therein for formation of a layer. Useful vehicles include conventional resins used for coating materials and having a high weatherability and excellent physical and chemical properties. Most preferred resins are thermosetting resins produced by mixing an acrylic resin, polyester resin or alkyd resin with an amino resin, isocyanate compound, blocked isocyanate compound or like crosslinking agent. Also usable are resins which can dry or cure at ambient temperature. The metallic coating is used in the form of usually an organic solvent solution, and possibly a nonaqueous dispersion, aqueous solution, water-dispersible solution, solvent-free form or powder.

The amount of iron oxide particles used is about 0.1 to about 30 parts by weight, preferably about 5 to about 20 parts by weight, per 100 parts by weight of the vehicle component (as solids). Less than 0.1 part by weight of the oxide particles used tends to fail to give the sparkling luster unique to the particles, whereas more than 30 parts by weight of the particles used is prone to decrease the serviceability of metallic coat.

The metallic coating used in the present invention comprises the iron oxide particles and the vehicle component as main components and may further contain an iridescent luster pigment such as micaceous titanium, colored micaceous titanium or the like to afford variations of colors.

The micaceous titanium is prepared by coating the surface of flaky mica with titanium dioxide to form a thin film therearound and assumes various interference colors such as silver, gold, red, purple, blue or green color depending upon the thickness of titanium dioxide film. On the other hand, colored micaceous titanium is produced by further coating the surface of the thus coated micaceous titanium with colloidal particles of a coloring inorganic compound to form a thin film of the particles therearound and has a color different from that of micaceous titanium. Useful coloring compounds (as colloidal particles) are iron oxide, iron hydroxide, chromium oxide, chromium hydroxide and the like. The micaceous titanium can be colored almost as desired although the resulting color depends on the color of micaceous titanium itself.

When the iron oxide particles (specific gravity, usually about 5.2) are used conjointly with the iridescent luster pigment (specific gravity, usually about 3.2 to about 3.7), the former is distributed in the depth of the layer and the latter in the surface portion thereof due to the difference in specific gravity between them. Iron oxide particles are practically impervious to light, causing the reflection of light, whereas an iridescent luster pigment is pervious to light. When the layer of metallic coating contains such two components, incident light beams presumably behave as follows: (1) some of light beams reach the iron oxide particles mostly to reflect thereon; (2) some of light beams reach the iridescent luster pigment mostly to pass therethrough; (3) some of the light beams having penetrated the pigment in the case (2) reach the iron oxide particles to reflect thereon; and (4) some of the light beams reach the colored layer to reflect thereon. Of the light beams in the four cases, the reflected light beams in the case (1) turn away outwardly or pass through the iridescent luster pigment distributed above the iron oxide particles. In particular, because of the increase in the intensity of the interference colors produced by the iridescent luster pigment, the reflected light beams having penetrated the pigment and combined with some of reflected light beams in the case (4) serve to form a finish coat having a unique effect due to mixing of colors without the diminish in intensity of interference colors otherwise occurring due to the mixed interference colors when the different interference colors are intended to be simultaneously utilized.

Useful iridescent luster pigments are those of any flaky shape and have such a distribution of particle size that the pigment having a particle diameter of about 50 μm or less accounts for 80% by weight or more, preferably about 90% by weight or more, more preferably about 95% by weight or more, of total pigment of which the pigment having a particle diameter of about 10 to about 40 μm amounts to about 60% by weight or more, preferably about 70% by weight or more, more preferably about 75% by weight or more. The pigment preferably has a thickness of about 0.2 to about 0.5 μm. The suitable amount of the pigment used is about 0.1 to about 20 parts by weight per 100 parts by weight (as solids) of the vehicle component.

The methods for dispersing the iron oxide particles and the iridescent luster pigment in the vehicle component are not specifically limited, but are preferably carried out without vigorous stirring to avoid damaging the titanium dioxide film in case the iridescent luster pigment is contained in the vehicle component. The dispersing can be easily done with a stirrer of the type commonly used.

When required, the metallic coating composed predominantly of the iron oxide particles and vehicle component may further contain any of usual metallic pigments, color pigments, extended pigments, additives for coating materials and the like insofar as the additive used does not adversely affect the intended purpose of the invention.

The metallic coating is applied to the surface of color coating layer by conventional coating methods such as electrostatic coating, air spraying, immersion, airless spraying or the like. The thickness of cured or dried layer is about 10 to about 30 μm, preferably about 15 to about 25 μm.

The clear coating composition (hereinafter referred to as "clear coating") will be described below.

The clear coating to be used in the present invention is applied to the surface of metallic coating layer to form a transparent layer, and contains a vehicle component as the main component. Suitable vehicle component, form of coating composition, coating method and the like can be selected from the examples thereof described above on the metallic coating. When required, the clear coating may include a small amount of color pigment, extender pigment, metallic pigment, said mica pigment, iron oxide pigment, ultraviolet absorber and the like.

While specifically not limitative, the thickness of clear coating layer is about 30 to about 70 μm, preferably about 40 to about 60 μm, based on the cured or dried layer.

The finish coating method of the present invention will be described below.

First, the color coating is applied directly to a chemically treated or untreated substrate to be coated (preferably automobiles composed of metals, plastics and the like) or to a substrate to be coated which has been primed, e.g., by electrodeposition, surfacer or topcoat. Then the metallic coating is applied to the surface of color coating layer uncured or undried, or cured or dried. Lastly the clear coating is applied to the surface of the metallic coating layer uncured or undried, or cured or dried, followed by curing or drying of the layer(s).

There exists the following relationship between the size of the iron oxide particles in the metallic coating on one hand and the thickness of the clear coating layer. When the longitudinal size of the particles is relatively small in the above-specified range of the distribution, a finished coat is given a high distinctness-of-image gloss by applying the clear coating to a thickness of about 30 to about 50 μm. On the other hand, when the longitudinal size thereof is relatively large within said range, the clear coating is applied preferably to a thickness of about 40 to about 70 μm to provide a finished coat with a high distinctness-of-image gloss. In this case, if the clear coating is difficult to apply to a thickness of 40 μm or more by one application, the clear coating may be twice applied. The two applications of clear coating are effected preferably by, e.g. depositing the metallic coating and the clear coating (in first application) on a wet-on-wet coating method, curing or drying the layers, polishing when required the cured or dried layers, depositing the clear coating (in second application), and curing or drying the layer.

The curing in these coating methods is done by three-dimensionally crosslinking of the layer(s) at room temperature or at an elevated temperature, and the drying is accomplished by drying of the layer(s) by simple evaporation of the solvent to achieve the formation of the layer(s). The heat-curing temperature can be suitably determined by varying the composition of vehicle used.

According to the present invention, the following remarkable results can be accomplished.

(i) The iron oxide particles used in the present invention has a twofold color effect, i.e. an effect of metallic color and solid (non-metallic) color. More specifically, when exposed to the direct rays of the sun, the particles are able to produce a uniquely sparkling luster markedly superior to that obtained by aluminum powder, nevertheless showing a solid color tone in the shade.

(ii) Under the direct rays of the sun, the metallic coat of the invention is substantially free of flip-flop effect. Further the metallic coat of the invention shows the same degree of sparkling luster when viewed at any deflected angle as well as the angle of specular reflection. In addition, the metallic coat of the invention glitters not only at the surface thereof but also in its depth as if diamonds were laid deep in the coat, and looks three-dimensional. Such remarkable degree of sparkling luster, moreover, can be attained even in the finish coat of deep color.

(iii) The combination of additional metallic pigment and the iron oxide particles used in the invention gives an orientated sparkling luster to the metallic coat. More specifically, if a proper amount of metallic pigment is combined with the iron oxide particles, the finish coat as viewed from the angle of specular reflection is perceived as showing the combined colors of constituent pigments in sparkling luster, while the finish coat as viewed from the other angles displays the color of iron oxide particles in sparkling luster. Such color effect is obtained in the invention because the iron oxide particles used can exhibit sparkling luster in view from any angle.

(iv) The iron oxide particles used in the invention have a high resistance to acids and alkalis which leads to a finish coat having a satisfactory serviceability.

(v) Since the metallic coat formed by the method of the present invention exhibits a low value and the metallic coating has a low concentration by volume of the pigments, the metallic coat is unlikely to produce an irregular metallic effect or to have an impaired uniformity of sparkling luster even if variations occur in the viscosity of the metallic coating, the composition of a thinner as a diluent, coating conditions, the thickness of coated layer and the like.

(vi) Two or more different iridescent luster pigments capable of exhibiting different interference colors as used in combination with the iron oxide particles can display a splendid, unique effect due to mixing of colors without any reduction in the intensity of each interference color produced by the iridescent luster pigments, thereby giving a epoch-making design as a color effect.

The present invention will be described below in more detail with reference to the following examples and comparison examples in which the parts and percentages are all by weight unless otherwise specified.

1. Substrate

The substrate to be coated is one made by treating a steel panel with zinc phosphate and covering the treated substrate with a cured 15 μm-thick layer of an epoxy polyamide-type cationic electrocoating composition (trade name "ELECTRON No.9000 Black," product of Kansai Paint Co., Ltd.) and a cured 30 μm-thick layer of a surfacer of amino resin/alkyd resin type (trade name "ES PRIMER TP-16 R GRAY," product of Kansai Paint Co., Ltd.) and heating the two layers for curing.

2. Color coating

The color coatings used are organic solvent solution-type thermosetting coatings A, B and C (including as the solvent a toluene/xylene mixture in a weight ratio of 1:1) comprising the components as shown below in Table 1.

TABLE 1

| | A | B | C |
|---|---|---|---|
| Vehicle components (part) as solids | | | |
| Acrylic resin | 70 | 70 | 7 |
| Butylated melamine resin | 30 | 30 | 30 |
| Pigment components (part) | | | |
| Titanium dioxide | 50 | 10 | |
| Barium sulfate | 10 | 20 | 20 |
| Carbon black | 1 | 2 | 5 |
| Phthalocyanine blue | 4 | 4 | |
| Quinacridone red | 2 | 2 | |
| Color of layer | | | |
| Value | 4 | 2 | 0.4 |
| Chroma | 2.36 | 1.61 | Neutral |
| Hue | 1.06 PB | 5.14 PB | Neutral |

3. Iron oxide pigment-containing coating

The coatings used are organic solvent solution-type thermosetting coatings (a), (b) and (c) (including as the solvent a toluene/xylene mixture in a weight ratio of 1:1) containing the main components as shown below in Table 2.

TABLE 2

| | (a) | (b) | (c) |
|---|---|---|---|
| Iron oxide particles | | | |
| $\alpha$-$Fe_2O_3$ content (%) | 99.1 | 99.1 | 99.1 |
| FeO content (%) | 0.2 | 0.2 | 0.2 |
| Mn content (%) | 0.7 | 0.7 | 0.7 |
| Longitudinal size | | | |
| Content of particles 30 μm or less in size (%) | 97.4 | 97.4 | 97.4 |
| Content of particles 5 to 15 μm in size (%) | 55.8 | 55.8 | 55.8 |
| Thickness (μm) | 0.4–1.0 | 0.7–1.0 | 1.0–3.0 |
| Vehicle component (part) as solids | | | |
| Acrylic resin | 70 | 70 | 70 |
| Butylated melamine resin | 30 | 30 | 30 |
| Iron oxide particles (part) | 10 | 13 | 18 |
| Iridescent luster pigment (part) | | | |
| (i) | — | — | 2 |
| (ii) | — | 2 | — |
| (iii) | — | 2 | 2 |

The composition of the iridescent luster pigment in Table 2 is as shown below in Table 3.

TABLE 3

| | Iridescent luster pigment | | |
|---|---|---|---|
| Color | (i) Gold | (ii) Red | (iii) Blue |
| Composition | | | |
| Mica (%) | 76.4 | 75.0 | 72.9 |
| $TiO_2$ (%) | 23.1 | 24.5 | 26.6 |
| $SnO_2$ (%) | 0.5 | 0.5 | 0.5 |
| Content of pigment 50 μm or less in diameter (%) | 98.2 | 98.2 | 98.2 |
| Content of pigment | 80.6 | 80.6 | 80.6 |

TABLE 3-continued

| Color | Iridescent luster pigment (i) Gold | (ii) Red | (iii) Blue |
|---|---|---|---|
| 10 to 40 μm in diameter (%) | | | |
| Thickness (μm) | 0.2–0.5 | 0.2–0.5 | 0.2–0.5 |

4. Clear coating

The clear coating used is an organic solvent solution-type thermosetting coating (including as the solvent a toluene/xylene mixture in a weight ratio of 1:1) composed predominantly of 70 parts of acrylic resin and 30 parts of butylated melamine resin as vehicle components.

The color coatings A, B or C, and the metallic coatings (a), (b) or (c) and the clear coating as specified above were applied to the coated substrate under the conditions as indicted below in Table 4.

TABLE 4

| | Example 1 | 2 | 3 | 4 | 5 | 6 | 7 | 8 | Comparison Example 1 | 2 | 3 | 4 |
|---|---|---|---|---|---|---|---|---|---|---|---|---|
| Color coating | | | | | | | | | | | | |
| Kind of coating | A | A | A | B | B | B | C | C | A | B | A | B |
| Layer thickness (μm) | 20 | 25 | 30 | 20 | 25 | 30 | 25 | 25 | 25 | 25 | 25 | 25 |
| Baking (*1) | B1 | B1 | B1 | B2 | B2 | B2 | B1 | B1 | B1 | B2 | B1 | B2 |
| Metallic coating | | | | | | | | | | | | |
| Kind of coating | (a) | (b) | (c) | (a) | (b) | (c) | (a) | (b) | (*2) | (*2) | (*3) | (*3) |
| Layer thickness (μm) | 15 | 20 | 25 | 15 | 20 | 25 | 15 | 20 | 20 | 20 | 20 | 20 |
| Baking (*1) | B2 | B2 | B2 | B2 | B1 | B2 | B2 | B1 | B2 | B1 | B2 | B1 |
| Clear coating | | | | | | | | | | | | |
| Layer thickness (μm) | 30 | 25 | 25 | 30 | 30 | 25 | 30 | 30 | 25 | 30 | 25 | 30 |
| Baking (*1) | B1 | B1 | B1 | B1 | B1 | B1 | B1 | B1 | B1 | B1 | B1 | B1 |
| Layer thickness (μm) | — | 25 | 25 | — | — | 25 | — | — | 25 | — | 25 | — |
| Baking (*1) | — | B1 | B1 | — | — | B1 | — | — | B1 | — | B1 | — |

Note:

(*1) B1 means that the layer was baked at 140° C. for 30 minutes. B2 means that the layer was not baked but was set at room temperature for 5 to 10 minutes, followed by the consequent step.

(*2) The iron oxide particles of the metallic coating (a) were replaced by aluminum powder.

(*3) The iron oxide particles of the metallic coating (b) were replaced by a mixture of the iridescent luster pigments (ii) and (iii) in a weight ratio of 1:1.

The layers formed in Examples 1 to 8 and Comparison Examples 1 to 4 on the coated substrates under the conditions as listed above in Table 4 were all tested for sparkling luster, orientation, resistance to acids, resistance to alkalis and effect due to mixing of colors by the following test methods.

Sparkling luster

The layers were observed at the angle of specular reflection under the direct rays of the sun and the sparkling luster was evaluated according to the following ratings:

(A) The finish coat was uniformly sparkling in its entirety as if diamonds were laid in the depth of the coat and gave a substantial degree of three-dimensional impression.

(B) The finish coat was unsatisfactory in sparkling luster and in three-dimensional characteristics.

(C) The finish coat was substantially unable to show a sparkling luster and failed to give an three-dimensional impression.

Orientation

The degree of sparkling luster of the finish coat as observed from various angles in the sparkling luster test was evaluated according to the following ratings:

(A) The sparkling luster underwent virtually no change even when the finish coat was viewed from varied angles.

(B) With the increase of deflection from the angle of specular reflection, the degree of sparkling luster lowered.

(C) The degree of sparkling luster was unsatisfactory when the metallic coat was observed at any angle.

Resistance to acids

The coated substrate was immersed in a 5% aqueous solution of sulfuric acid for 24 hours and checked for the resistance to acids. The resistance was evaluated according to the following ratings:

(A) No fault.

(B) The finish coat had slight extents of stains and blisters.

Resistance to alkalis

The finish coat was immersed in a 5% aqueous solution of sodium hydroxide for 24 hours and checked for the resistance to alkalis. The resistance was evaluated according to the following ratings:

(A) No fault.

(B) The finish coat had slight extents of stains and blisters.

Effect due to mixing of colors

The effect due to mixing of colors was evaluated according to the following ratings using a mixture of iron oxide particles and one or two kinds of iridescent luster pigment.

A. The colors of iron oxide particles and pigment(s) were each displayed to provide satisfactory aesthetic properties.

B. A little inferior in aesthetic properties.

C. The intensity of colors are diminished due to the adverse effect exerted on each other by the colors, resulting in impairment of aesthetic properties.

Table 5 below shows the results.

TABLE

| | Example | | | | | | | | Comparison Example | | | |
|---|---|---|---|---|---|---|---|---|---|---|---|---|
| | 1 | 2 | 3 | 4 | 5 | 6 | 7 | 8 | 1 | 2 | 3 | 4 |
| Sparkling luster | A | A | A | A | A | A | A | A | B | B | C | C |
| Orientation | A | A | A | A | A | A | A | A | B | B | C | C |
| Resistance to acids | A | A | A | A | A | A | A | A | B | B | A | A |
| Resistance to alkalis | A | A | A | A | A | A | A | A | B | B | A | A |
| Effect due to mixing of colors | — | A | A | — | A | A | — | A | — | — | C | C |

What is claimed is:

1. A coating method comprising the steps of applying a color coating composition to a substrate, applying a metallic coating composition containing a metallic pigment to the layer of the color coating composition and applying a clear coating composition to the layer of the metallic coating composition, the method being characterized in that the color coating composition is able to form a layer having a Munsell value of 0 to 6; that the metallic coating composition contains the metallic pigment and a vehicle as main components, the metallic pigment being iron oxide particles of hexagonal platelike shape which contain at least 80% by weight of α-iron oxide crystals; that about 90% by weight or more of the metallic pigment has a longitudinal size of about 30 μm or less and 40% by weight or more of the pigment has a longitudinal size of about 5 to about 15 μm; that the thickness of the pigment is about 1/10 to about 1/20 of the longitudinal size of the pigment; and that the amount of the pigment used is about 0.1 to about 30 parts by weight per 100 parts by weight of the vehicle (as solids).

2. A coating method according to claim 1 wherein the color coating composition is able to give a layer having a Munsell value of 0.3 to 4.

3. A coating method according to claim 1 wherein the iron oxide particles contain 95% by weight or more of α-iron oxide crystals.

4. A coating method according to claim 1 wherein 95% by weight or more of the metallic pigment has a longitudinal size of about 30 μm or less.

5. A coating method according to claim 1 wherein 50% by weight or more of the metallic pigment has a longitudinal size of about 5 to about 15 μm.

6. A coating method according to claim 1 wherein the thickness of the metallic pigment is about 1/10 to about 1/15 of the longitudinal size of the pigment.

7. A coating method according to claim 1 wherein the amount of the metallic pigment is about 5 to about 20 parts by weight per 100 parts by weight of the vehicle (as solids).

* * * * *

UNITED STATES PATENT AND TRADEMARK OFFICE

CERTIFICATE OF CORRECTION

PATENT NO. : 4,950,507

DATED : August 21, 1990

INVENTOR(S) : Shizuo MIYAZAKI et al

It is certified that error appears in the above-identified patent and that said Letters Patent is hereby corrected as shown below:

On the cover page, Item [73], "Toyota Jidosha Kabushiki" should read --Toyota Jidosha Kabushiki Kaisha--.

Signed and Sealed this

Seventh Day of January, 1992

*Attest:*

HARRY F. MANBECK, JR.

*Attesting Officer*

*Commissioner of Patents and Trademarks*